US007543958B2

(12) United States Patent
Chi et al.

(10) Patent No.: US 7,543,958 B2
(45) Date of Patent: Jun. 9, 2009

(54) LIGHTING FIXTURE WITH A RETRACTABLE SENSOR MODULE AND METHODS OF OPERATING THE SAME

(75) Inventors: Yung Chih Chi, Taipei Hsien (TW); Ching-Chen Chen, Taipei Hsien (TW); Wei-Jen Ho, Taipei Hsien (TW); Kong Yeow Lai, Penang (MY)

(73) Assignee: IQ Group Sdn Bhd, Pulau Pinang (MY)

( * ) Notice: Subject to any disclaimer, the term of this patent is extended or adjusted under 35 U.S.C. 154(b) by 29 days.

(21) Appl. No.: 11/521,584

(22) Filed: Sep. 14, 2006

(65) Prior Publication Data

US 2008/0068841 A1 Mar. 20, 2008

(51) Int. Cl.
*F21V 23/04* (2006.01)

(52) U.S. Cl. ..... 362/276

(58) Field of Classification Search ..... 362/276
See application file for complete search history.

(56) References Cited

U.S. PATENT DOCUMENTS

| | | | | |
|---|---|---|---|---|
| 5,662,411 | A * | 9/1997 | Haslam et al. | 362/276 |
| 6,050,708 | A * | 4/2000 | Roorda | 362/375 |
| 6,120,165 | A * | 9/2000 | Shalvi | 362/276 |
| 6,196,705 | B1 * | 3/2001 | Finke et al. | 362/276 |
| 6,844,555 | B2 | 1/2005 | Beasley | |
| 2005/0012594 | A1 * | 1/2005 | Shim | 340/5.72 |

FOREIGN PATENT DOCUMENTS

DE 20 2004 018 647 U1 1/2004

* cited by examiner

*Primary Examiner*—Jacob Y Choi
*Assistant Examiner*—Robert May
(74) *Attorney, Agent, or Firm*—Botkin & Hall, LLP

(57) ABSTRACT

According to a first embodiment of the present invention, a lighting fixture is provided with a housing space to receive a retractable sensor module. The housing space is provided with an internal holder with electrical circuitry to operate the lighting fixture. The internal holder is essentially cylindrical in shape, with one closed end. The closed end is provided with openings and slots for screw and wires. The internal holder allows for pan rotation of a retractable sensor module. The retractable sensor module includes a control module comprising a top cover, a lower cover and a printed circuit board sub-assembly inside, and a lens assembly. The printed circuit board sub-assembly comprises a power printed circuit board, a sensor printed circuit board, with a printed circuit board and a transmitter printed circuit board. The lens assembly constitutes dotted lenses.

The lighting fixture is independently operable, after the sensor module has been detached and a dummy cover is employed to close off the housing space of the internal holder.

In a second embodiment, the lighting fixture with a sensor module can be further fitted with a plug-in transmitter module. The transmitter module receives and re-directs a signal from the sensor module to activate a receiver product, including a chime or a lighting fixture, in a separate part of a building or an operation control room.

7 Claims, 11 Drawing Sheets

101b
SEE DETAIL A
31
33
30
20
10
200
50
Screw Driver 101b
31
21
33
30
20
10
200

31
30
40
20
200
SEE DETAIL A

LIGHTING FIXTURE WITH A RETRACTABLE SENSOR MODULE AND METHODS OF OPERATING THE SAME

BACKGROUND OF THE INVENTION

1. Technical Field

The present invention relates generally to a controlled lighting fixture with a sensor module. It relates specifically to a retractable sensor module adapted for horizontal or vertical mounting on a lighting fixture, and methods of operating the same.

2. Background Art

A modern uncontrolled lighting fixture normally includes a lamp housing and a light inside. It is not adapted with any sensor module to control its lighting operation. A switch is normally provided, external to the lighting fixture.

In the case of security lighting and controlled lighting, a focusing spotlight or utility light is employed to direct its light beam in a predetermined direction, and a separate passive infrared (PIR) motion sensor device is electrically connected to the spotlight or other light. Sensor-controlled lighting apparatus is mainly used as outdoor lighting fixture to provide ambient light for residential house, apartment walkway, stairs, car porch, garden and such like, where the sensor detects motion in a comparatively dark environment.

Currently in the market, retailers have to carry stocks for controlled lighting fixtures and uncontrolled lighting fixtures separately. This can be considered as a financial burden to their operating costs. Furthermore, most saleable prior art lighting fixtures are of the uncontrolled type, and they may not be aesthetic to the eyes. Where the uncontrolled lighting fixture is acceptable to a consumer, the consumer does not have a choice of adding any sensor mechanism subsequently, once it has been installed. The consumer must purchase a separate new controlled lighting fixture to replace the uncontrolled lighting fixture. Often, the same lighting fixture is not readily available. The above situation is not convenient as well as cost effective. In the case of a controlled lighting fixture, the sensor is more or less permanently attached. In other words, the current practice of lighting fixture design compels a consumer to make an early decision on installing controlled or uncontrolled lighting fixture.

In a German Patent no. DE 20 2004 018 647, a sensor lamp with a lamp unit activateable in reaction to a sensor output signal of a motion sensor unit operating preferably on infrared basis is disclosed. The lamp unit is provided on a carrier for mounting the sensor lamp indoor or outdoor. The motion sensor unit is module-like. When the carrier is mounted, the motion sensor is configured such that it can be detached therefrom and comprises at least one adjusting element to be actuated manually, which can be actuated in the detached state of the motion sensor unit.

In a U.S. Pat. No. 6,844,555 B2, the patent discloses a covering and mounting structure for a motion detector having light emitting diodes and electronic adjustment controls. The structure can be cylindrical or non-cylindrical in shape, and disposed in pendant or standing-post arrangement. The structure includes a telescopic structure or an exterior cover for the selective covering. In one embodiment, the structure includes one downwardly viewing first motion detector lens and a laterally viewing second PIR motion detector lens.

SUMMARY OF THE INVENTION

The present invention has, therefore, as an object to allow a consumer to use the same lighting fixture, which they like, with or without a sensor module.

Another object of the invention is to provide a retractable sensor module, as an add-on part to a lighting fixture.

Yet, another object of the invention is to provide additionally a plug-in transmitter module to a lighting fixture fitted with a retractable sensor module.

These objects are achieved in that a lighting fixture is provided with at least one housing space to house optionally a retractable sensor module and a plug-in transmitter module. An internal holder with electrical contacts is disposed inside the housing space for the sensor module. The retractable sensor module includes a lens assembly and a control module, which also includes a printed circuit board sub-assembly which is a technically known technology. In an uncontrolled lighting situation, when the sensor module is removed, the wiring is short-circuited. The lighting fixture is then operable by a normal on/off switch. In a controlled lighting situation, the retractable sensor module is inserted into the internal holder and the retractable sensor module is adjusted by at least three external adjustment knobs on its side wall.

Other objects and advantages will become apparent following the disclosure of the invention in the following description.

BRIEF DESCRIPTION OF THE DRAWINGS

In order that the present invention may be more readily understood, the following description is given of two mounting orientations of a first embodiment of a lighting fixture to be fitted with an optional retractable sensor module. A second embodiment relates to a lighting fixture fitted with a retractable sensor module, further to be fitted with a plug-in transmitter module. Reference will be made to the accompanying drawings.

DETAILED DESCRIPTION OF INVENTION

Figure 2:
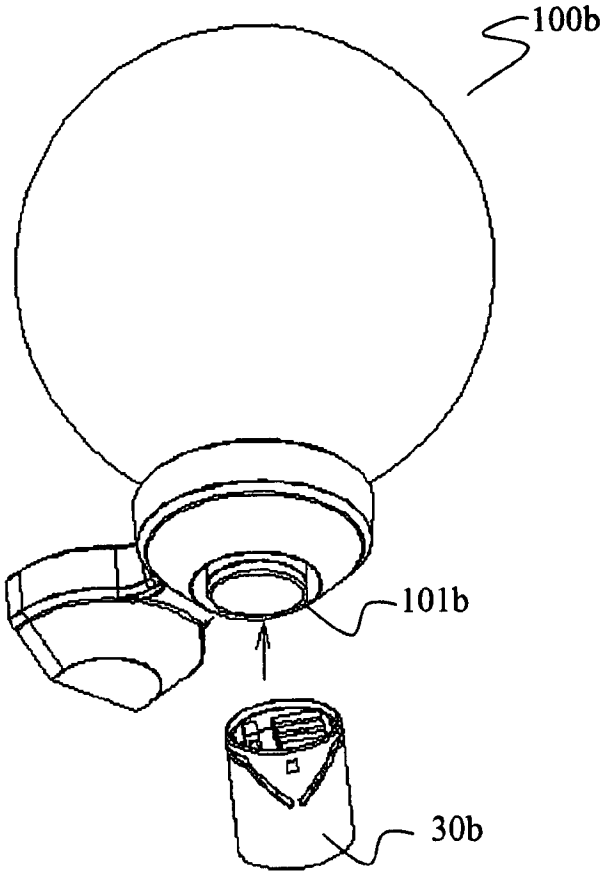
FIG. 2 shows a to-be assembled view of a first embodiment of a lighting fixture, with an internal holder, adapted for vertical mounting of the present invention.

In the following description, a lighting means and a support means constitute a lighting fixture. The lighting means can be decorative, or utility-type. The present invention teaches two embodiments of a lighting fixture (100), both adapted for horizontal or vertical mounting of a retractable sensor module (200). A first embodiment relates to a lighting fixture (100) that is optionally fitted with a retractable sensor module (200). A second embodiment relates to a first embodiment further optionally to be fitted with a plug-in transmitter module (90). Both modules (200, 90) can be separately purchased later by a consumer.

The sensor module (200) is made retractable so that adjustment knobs (61) can be concealed from view, when they are not in use.

The transmitter module (90) transmits a detected signal from the sensor module (200) to activate a receiver product, including a chime or even another lighting fixture, in another part of a building such as a kitchen or an operation control room.

For ease of description, same numerals are used to denote same components in the same embodiment or mounting orientation. Suffices "a" and "b" after same numeral are applied for different embodiments or mounting orientations, when differentiation is desired.

Figure 1:
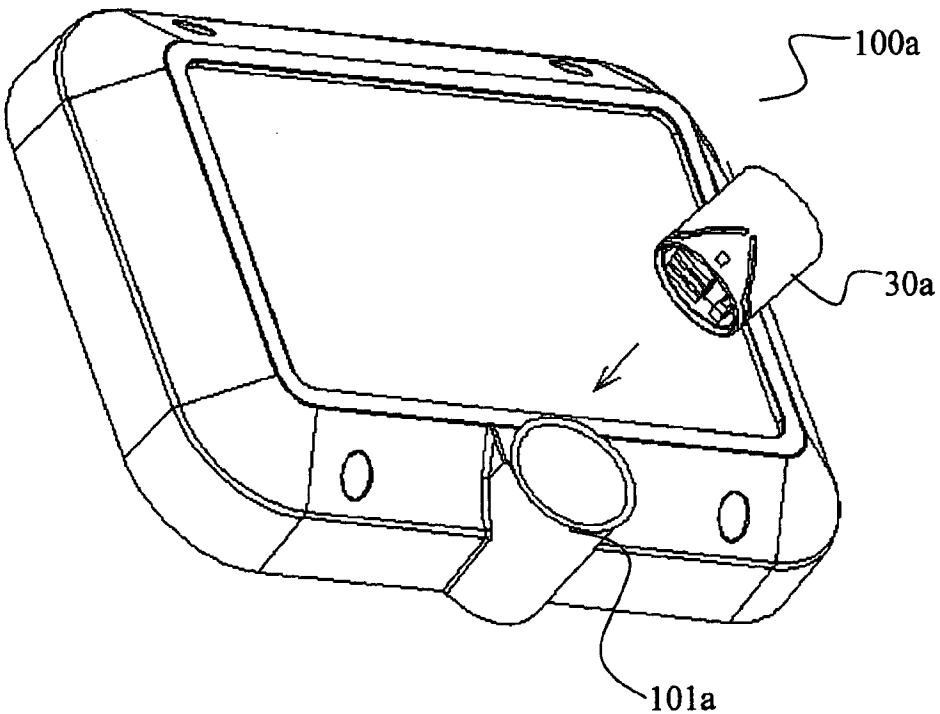
FIG. 1 shows a to-be assembled view of a first embodiment of a lighting fixture, fitted with an internal holder, adapted for horizontal mounting of the present invention.

FIG. 1 shows a rectangular lighting fixture (100*a*) adapted with a horizontal mounting of a retractable sensor module (200*a*). By "horizontal", it is meant that the axis of a housing space (101*a*) is horizontal. The housing space (101*a*) is disposed at the bottom side of the lighting fixture (100*a*) to hold the sensor module (200*a*). An internal holder (30*a*) is pre-assembled into this housing space (101*a*). The retractable sensor module (200*a*) according to the invention is effectively downward-sensing. When this retractable sensor module (200*a*) is withdrawn and not installed, a dummy cover is employed to close off the opening to the housing space (101*a*).

FIG. 2 shows a decorative bulb-like lighting fixture (100*b*) adapted for a vertical mounting of a retractable sensor module (200*b*). By "vertical", it is meant that the axis of a housing space (101*b*) is vertical. The housing space (101*b*) is disposed at the bottom side of the lighting fixture (100*b*) to hold the sensor module (200*b*). An internal holder (30*b*) is pre-assembled into this housing space (101*b*). The retractable sensor module (200*b*) in this figure is effectively horizontal-sensing. When this retractable sensor module (200*b*) is withdrawn and not installed, a dummy cover is employed to close off the opening to the housing space (101*b*).

The main innovation of the present invention is that the internal holder (30*a*, 30*b*) of the lighting fixture (100*a*, 100*b*) is adapted with a retractable sensor module (200*a*, 200*b*). The lighting fixture (100*a*, 100*b*) comprises essentially a lighting means and a support means which are known to those skilled in the art. In the first embodiment of the present invention, the lighting fixture (100*a*, 100*b*) is provided with the housing space (101*a*, 101*b*) which is pre-assembled with the internal holder (30*a*, 30*b*). The lighting fixture (100*a*, 100*b*) can be decorative or utility. A consumer essentially contemplates purchasing a lighting fixture (100) as it appeals to his or her eyes. Later on, when the need to control lighting arises, he or she can then purchase an appropriate sensor module (200). Where the consumer chooses the lighting fixture (100*a*, 100*b*) without a sensor module (200*a*, 200*b*), the opening to the housing space (101*a*, 101*b*) is simply covered with a dummy cover.

To facilitate explanation of its operation, the following description is directed to a first embodiment of the lighting fixture (100) adapted with a vertical mounting of the invention as shown in FIG. 2.

Figure 3B:
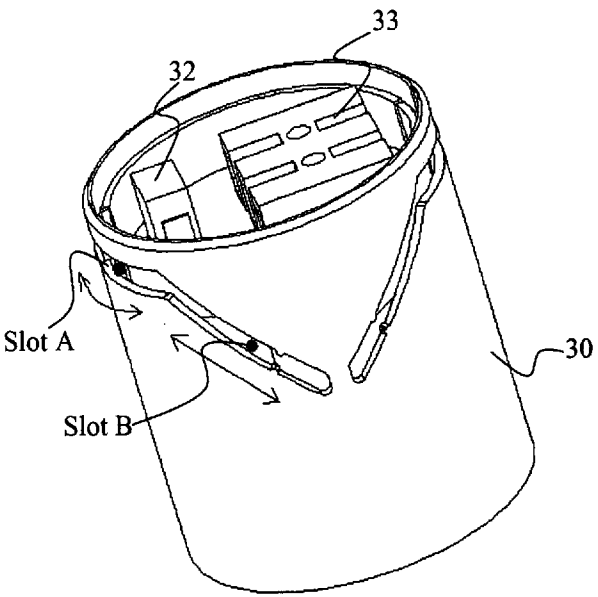
FIG. 3*b* shows a perspective view of the assembled internal holder as shown in FIG. 3*a*.
Figure 3A:
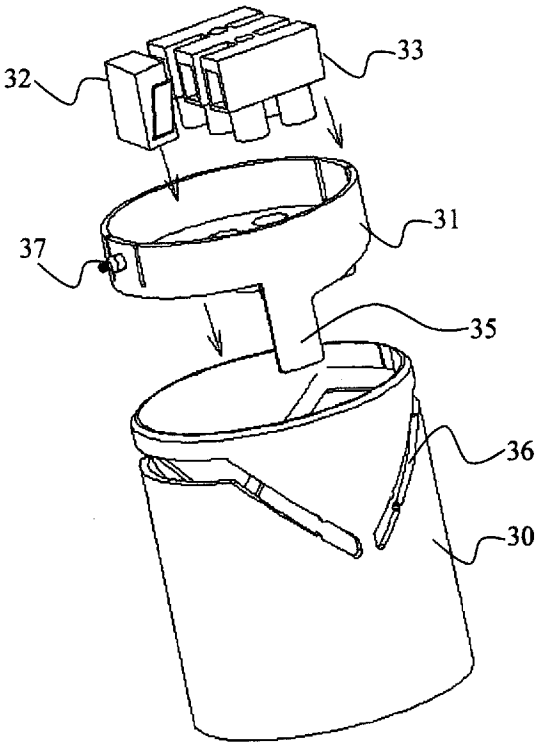
FIG. 3*a* shows a to-be-assembled view of various components making up the internal holder to be fitted into a housing cavity in a lighting fixture as shown in FIG. 1 or 2.

As seen in FIGS. 3*a* and 3*b*, the internal holder (30) carries a rotatable disc (31) which is provided with a micro-switch (32) and three electrical contacts (L, N, $L^1$) in a 3-pole terminal block (33) connecting to an alternating current mains circuitry operating the lighting fixture (100).

Furthermore, the internal holder (30) is essentially cylindrical in shape, with one top end closed by the rotatable disc (31). This cylindrical shape allows for pan rotation of the sensor module (200) to be fitted. When required, the sensor module (200) can be inserted to the internal holder (30). To those skilled in the art, various modes of release means can be applied to the internal holder (30), to hold and to release the sensor module (200) from the internal holder (30).

It is evident from FIGS. 3*a* and 3*b* that descending duct-ways (36) are provided on the cylindrical wall of the internal holder (30). The duct-ways (36) assist in the retraction and extension of the sensor module (200). A protrusion (37) is provided on the outer wall of the rotatable disc (31). This protrusion (37) engages and is made to slide along the duct-ways (36), whence the rotatable disc (31) moves axially up and down the internal holder (30).

An extended wall section (35) is also integrally provided at the bottom side of the rotatable disc (31). This extension wall section (35) aligns with the sensor module (200), when it slides into a receiving slot (11) disposed on a top cover (10) of the sensor module (200).

The lower cover (60) further includes an inner wall (63) with a plurality of catch means (64) and a control panel wall (62) with a plurality of adjustment knobs (61). The top cover (10) engages and snaps on the lower cover (60) with the assistance of the catch means (64). It is important to note that the control module (20) carries three terminal pins (21) which subsequently engage the three electrical contacts (L, N, $L^1$) carried by the internal holder (30). These three terminal pins (21) are electrically connectable to the printed circuit board sub-assembly inside the control module (20). The lens assembly (50) is semi-spherically shaped.

Figure 4B:
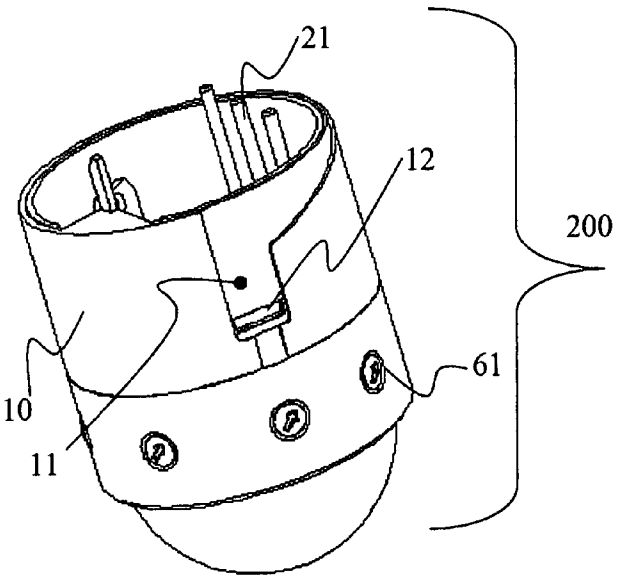
FIG. 4*b* shows a perspective view of the assembled retractable sensor module as shown in FIG. 4*a*.
Figure 4A:
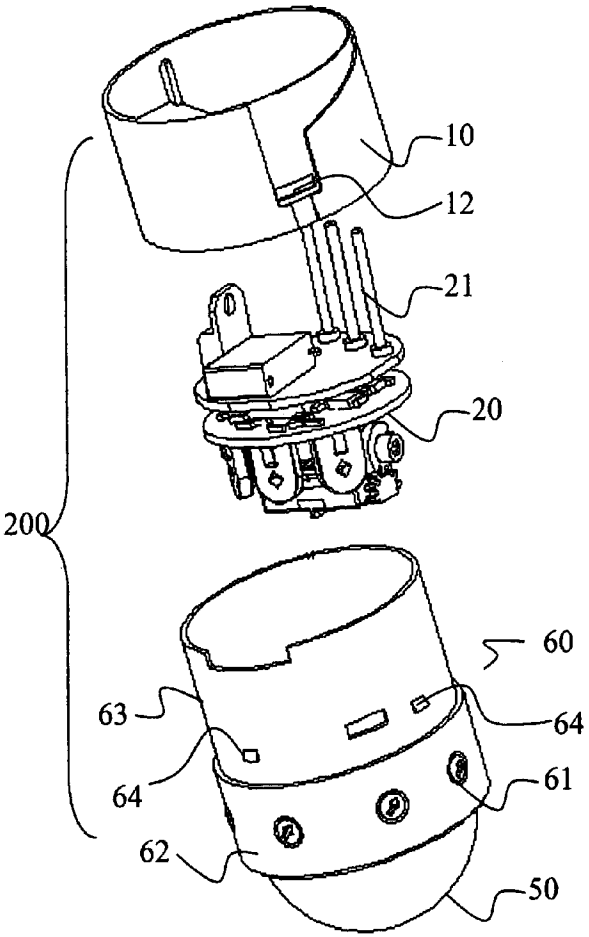
FIG. 4*a* shows a to-be-assembled view of various components making up a retractable sensor module in accordance with the present invention.

As seen in FIG. 4*b*, at least three adjustment knobs (61) are provided and protrude on the control panel wall (62) of the lower cover (60). These knobs (61) are electrically connectable to the printed circuit board sub-assembly in the control module (20).

Figures 5A, 5B:
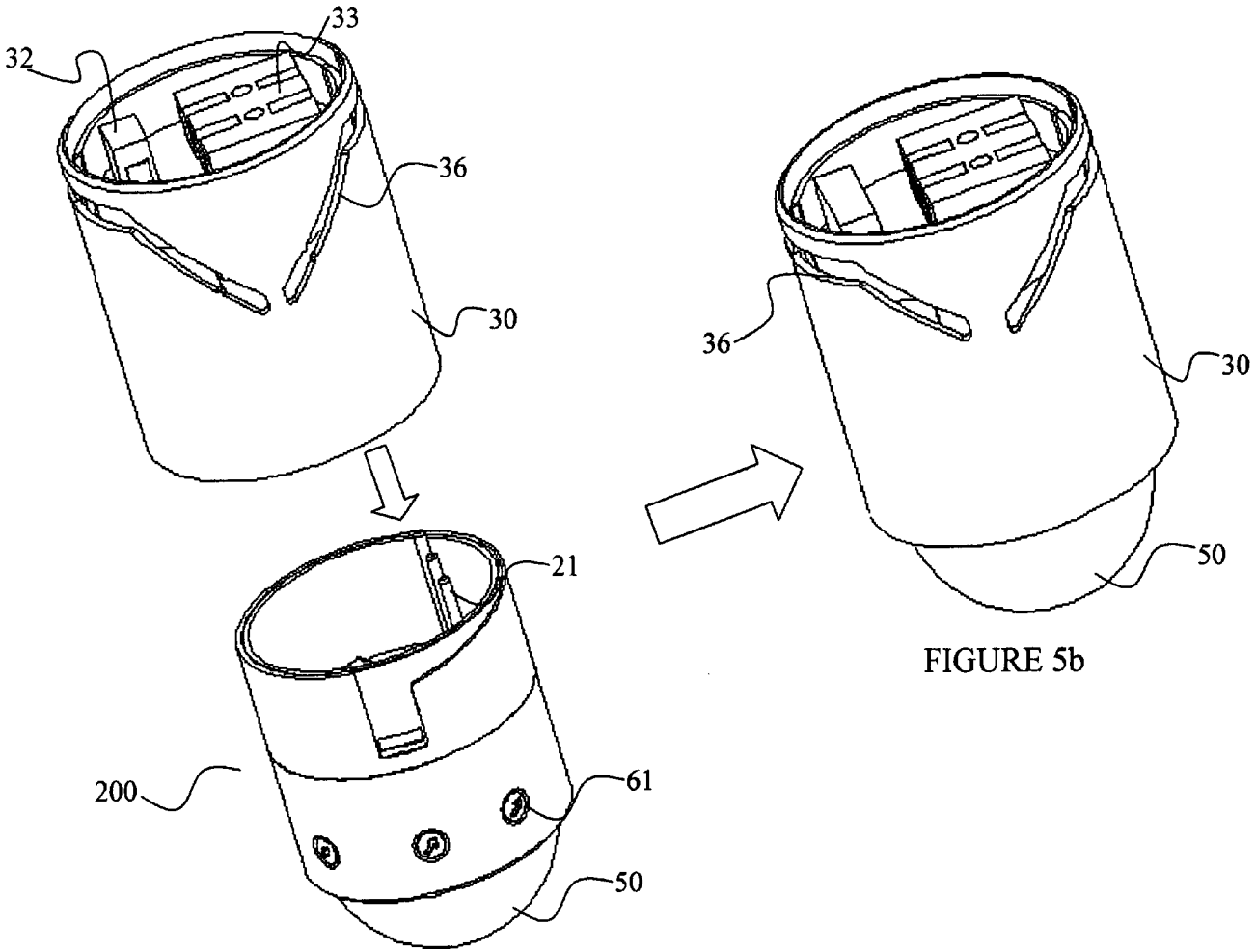
FIG. 5*a* shows a to-be assembled view of the internal holder as shown in FIG. 3*b* and the retractable sensor module as shown in FIG. 4*b*.
FIG. 5*b* shows a perspective view of an assembly of the internal holder and the sensor module, whence the sensor module is fully retracted.

As seen in FIGS. 5*a* and 5*b*, the sensor module (200) is fitted into the internal holder (30), without showing the lighting fixture (100). A dome portion of the lens assembly (50), even fully retracted, protrudes through the bottom end of the holder (30). The micro-switch (32) and the terminal block (33) are accessible from the top end of the internal holder (30), connectable electrically to the lighting means.

It is important to ensure that the electrical contacts (L, N, $L^1$) on the internal holder (30) must engage the three terminal pins (21) on the sensor module (200). It is also important to note that the rotatable disc (31) is electrically and physically connected to the retractable sensor module (200) with the assistance of terminal pins (21) and a catch (12).

Figure 6C:
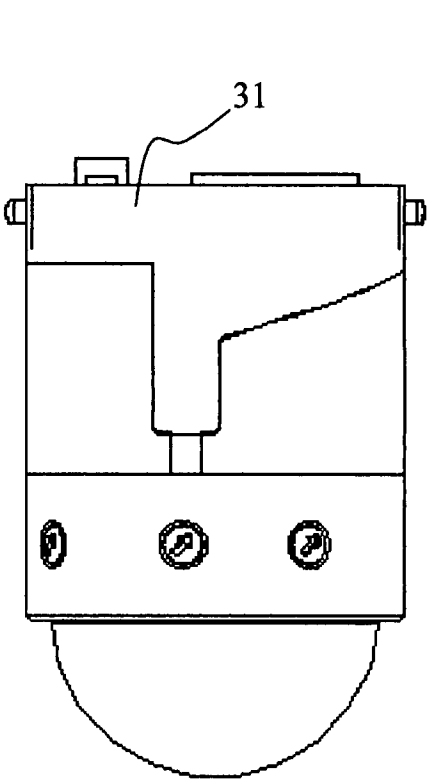
FIG. 6*c* shows a side view of an assembly of the internal holder and the sensor module in accordance with the present invention, whence the sensor module is fully retracted.
Figure 6B:
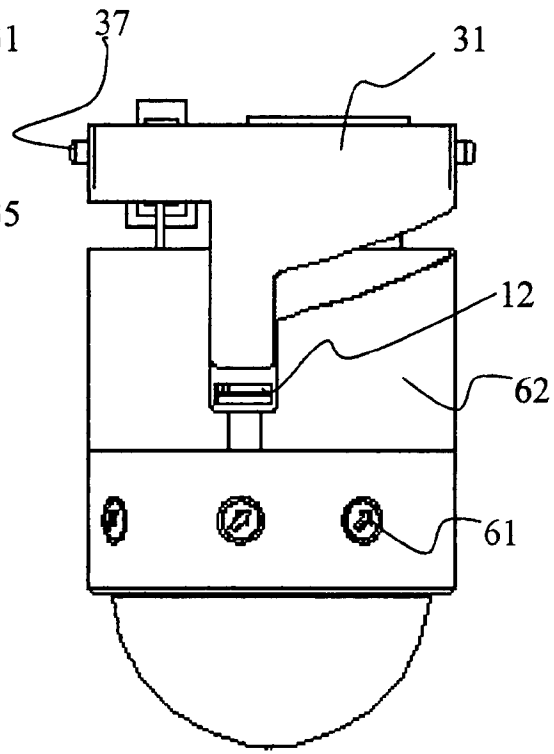
FIG. 6*b* shows a side view of an assembly of the internal holder and the sensor module in accordance with the present invention, whence the sensor module is being retracted.
Figure 6A:
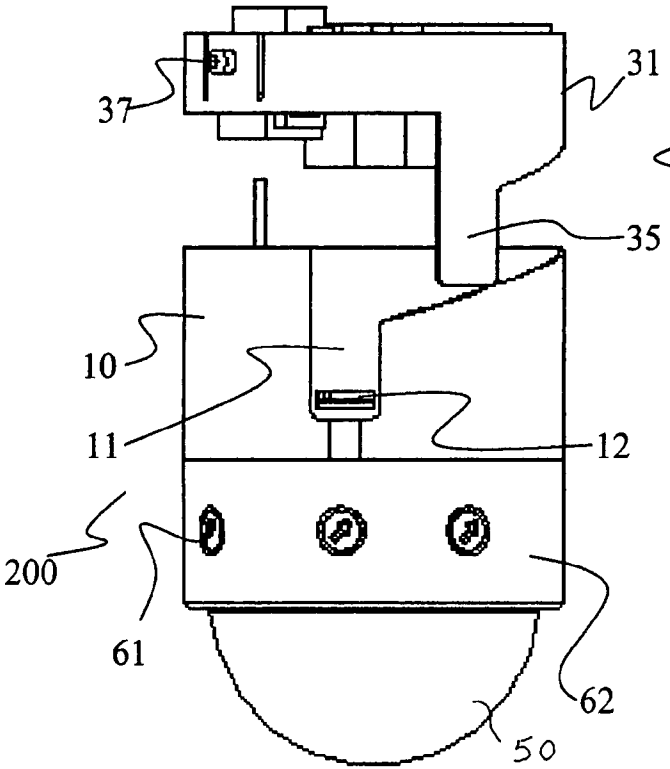
FIG. 6*a* shows a side view of an assembly of the internal holder and the retractable sensor module, whence the sensor module is pulled down or extended.

As seen in FIGS. 6*a*, 6*b* and 6*c*, the sensor module (200) can be pulled down from the internal holder (30) for adjustment. After adjustment, the sensor module (200) is pushed back into the internal holder (30). The adjustment knobs (61) are thus hidden inside the internal holder (30).

In order to facilitate the engagement of the sensor module (200) with the rotatable disc (31), a receiving slot (11) is integrally provided on the top cover (10). The rotatable disc (31) is aligned with the sensor module (200) when the extended wall section of the rotatable disc (31) is placed into the receiving slot (11) of the top cover (10). The catch (12) provided at the receiving slot (11) engages the rotatable disc (31). A screw driver (40) can be applied at the catch (12) to release its holding.

Figure 7A:
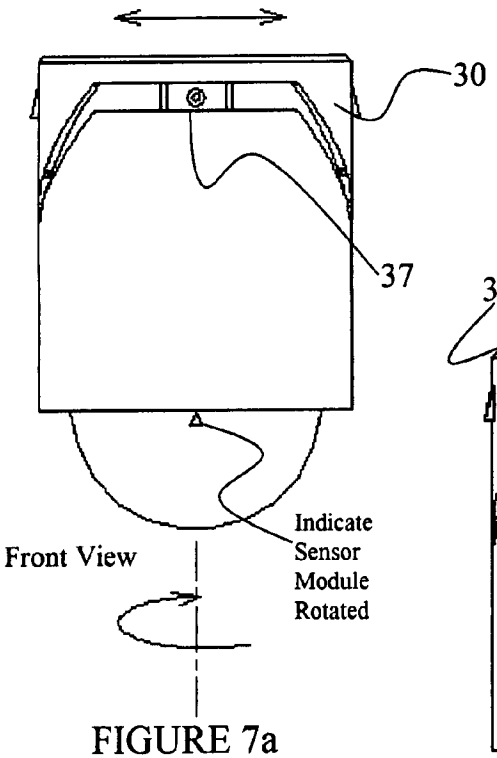
FIG. 7*a* shows a side view of the invention in a fully retracted position, when the sensor module is fully retracted.
Figure 7B:
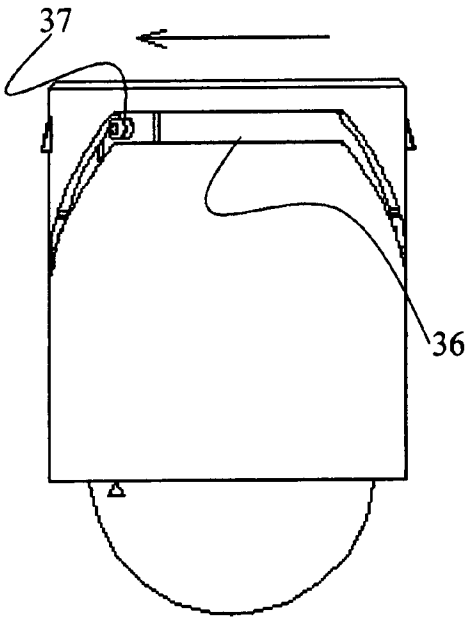
FIG. 7*b* shows a side view of the invention in a fully retracted position, when the sensor module is panned to the left.
Figure 7C:
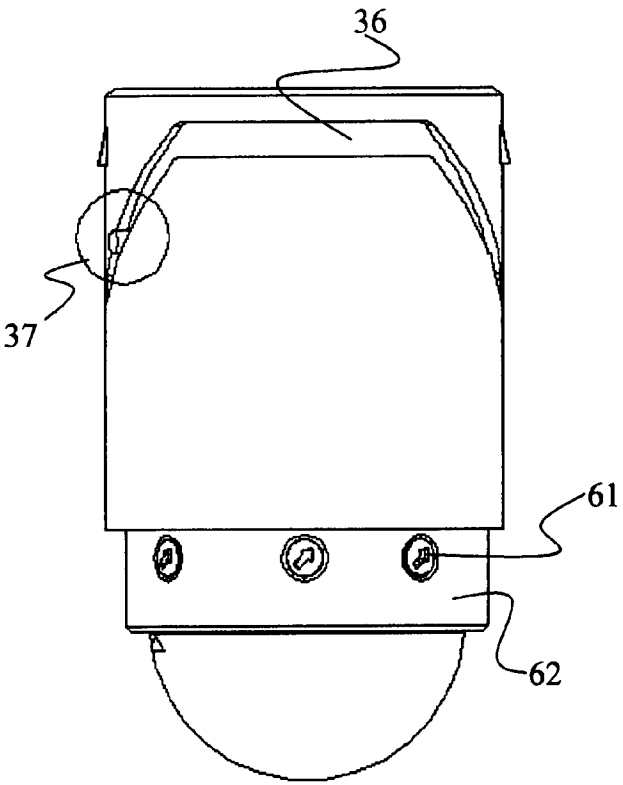
FIG. 7*c* shows a side view of the invention in a fully extended position, when the sensor module has been panned to the left.

FIGS. 7*a*, 7*b*, and 7*c* explain how the retractable sensor module (200) retracts or extends inside the internal holder (30). The protrusion (37) of the rotatable disc (31) is positioned by flexing on top of the horizontal duct-way (36) when the sensor module (200) is fully retracted. To expose the adjustment knobs (61), the sensor module (200) is extended and the protrusion (37) moves down the duct-way (36). When the sensor module (200) is fully extended, the adjustment knobs (61) become visible.

Figures 8A, 8B, 8C:
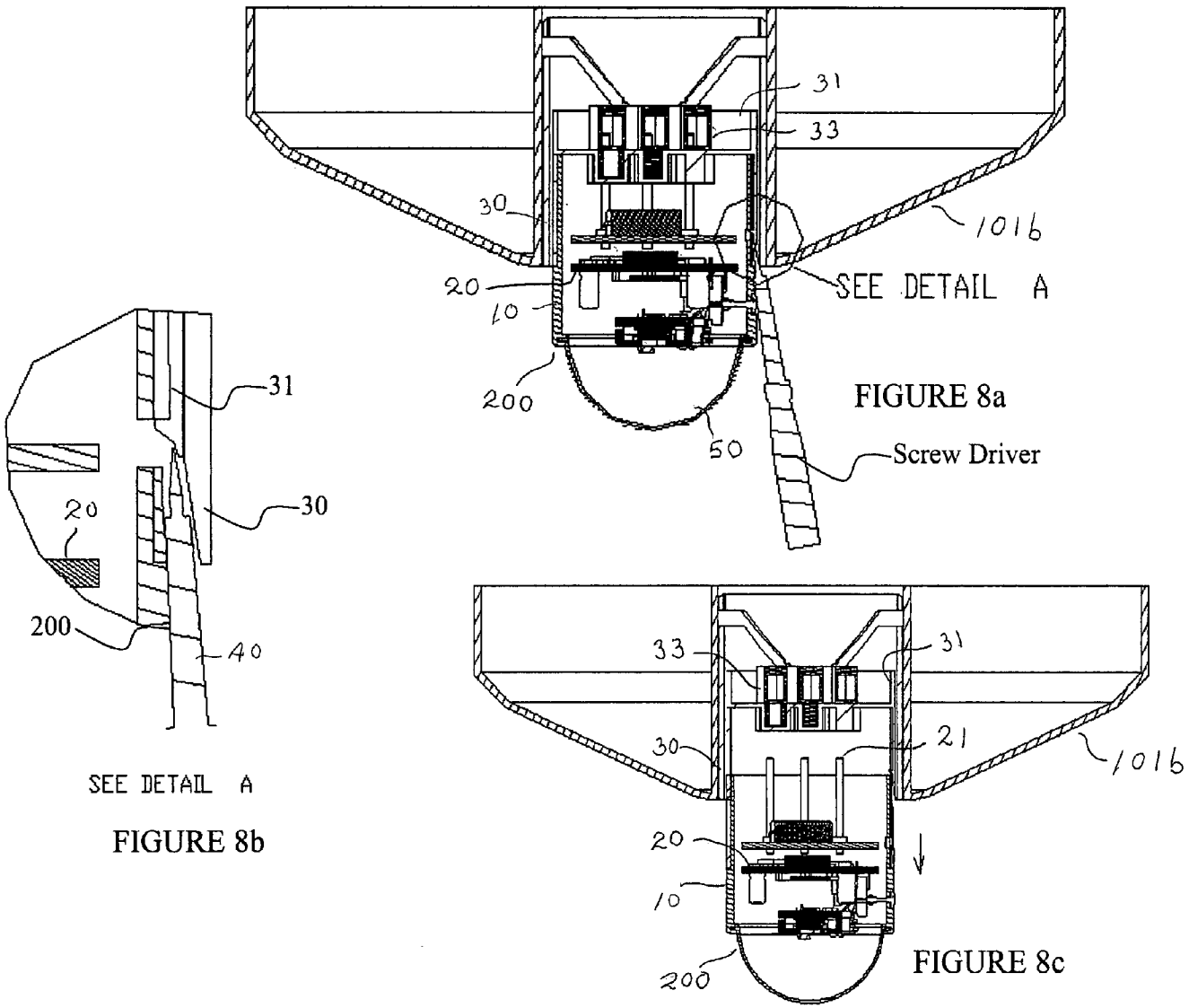
FIG. 8*a* shows a schematic view of the invention in a fully extended position, whence a screw driver is inserted to release the sensor module from the internal holder.
FIG. 8*b* shows a detailed schematic view of a catch means on the internal holder holding the sensor module.
FIG. 8*c* shows a schematic view of the invention as shown in FIG. 8*a*, whence the sensor module is being withdrawn.

As seen in FIGS. 8*a*, 8*b* and 8*c*, screw driver (40) is employed to release the catch (12) disposed on the rotatable disc (31) holding the sensor module (200). This releases the module from disc (31) and internal holder (30).

Figure 9A:
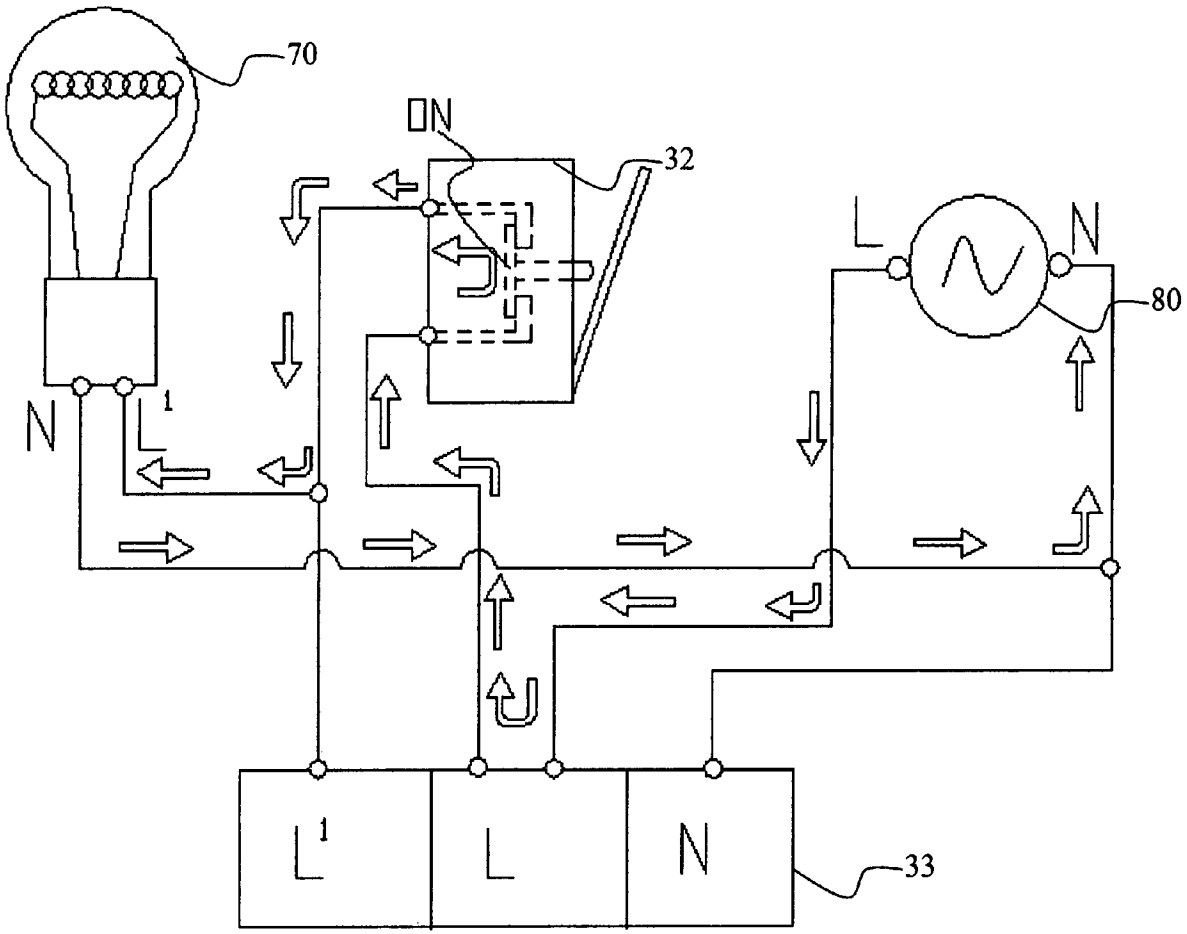
FIG. 9*a* shows a wiring diagram in schematic of a lighting fixture without a retractable sensor module in accordance with the present invention.

FIG. 9*a* shows the wiring when the retractable sensor module (200) is removed from the internal holder (30) and a dummy cover is inserted. This corresponds to a situation when a consumer has opted for an uncontrolled lighting fixture (100) having a light (70) or when the sensor module (200) becomes faulty and has to be replaced. The micro-switch (32) closes and the power main (80) operates light (70) such as a lamp through the L-$L^1$ connection. Hence, the light (70) is operable by a normal on/off switch. No additional wiring is required from a consumer.

Figure 9B:
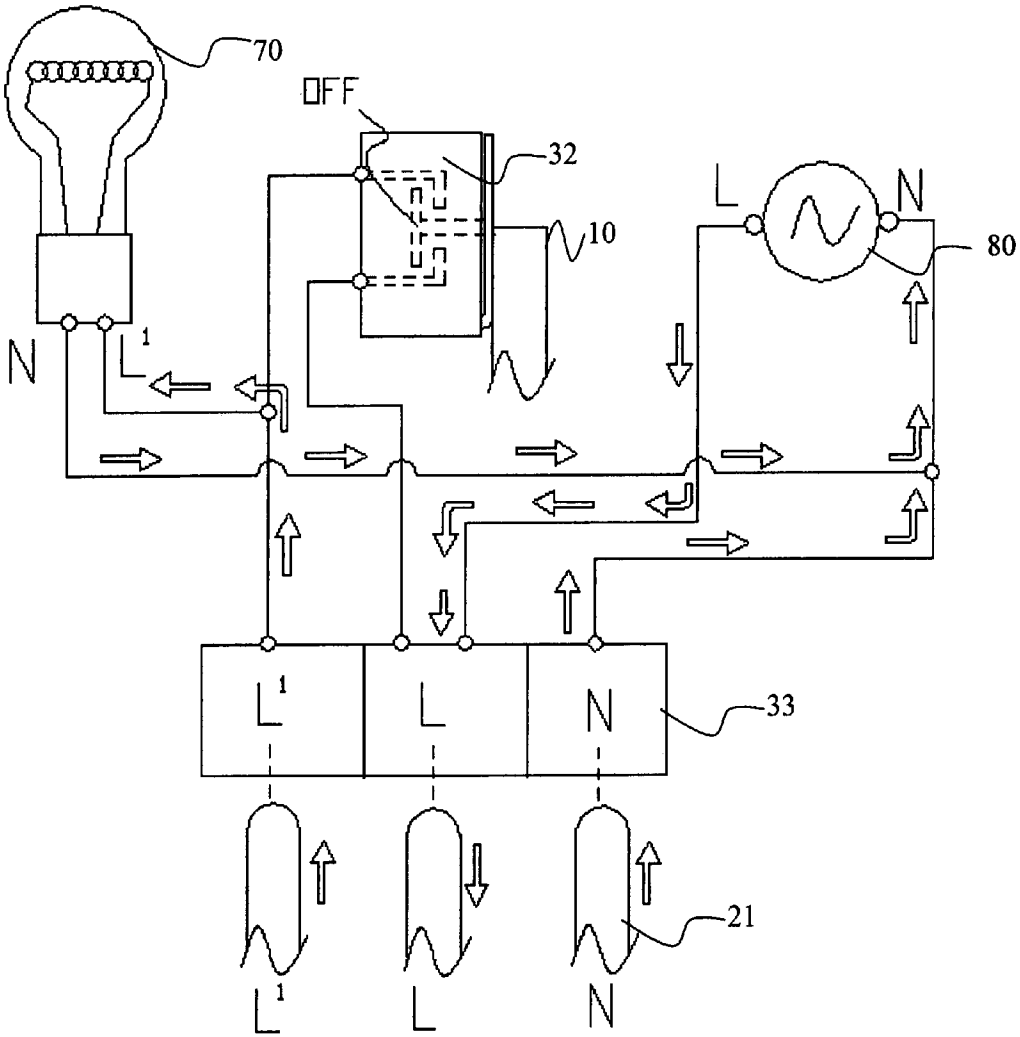
FIG. 9*b* shows a wiring diagram in schematic of a lighting fixture operating with a retractable sensor module in accordance with the present invention.

FIG. 9*b* shows the wiring when the sensor module (200) is inserted into the internal holder (30) to control lighting. The micro-switch (32) is placed in an "off" position. Three terminal pin ($L^1$, L and N) connections from the lower cover (60) are correspondingly inserted to the terminal block (33). The lower cover (60) is thus operable from the AC main (80). Whenever the lower cover (60) detects a movement, the sensor module (200) will switch on the light (70) through the $L^1$ connection. The electrical power is supplied through the $L^1$ contact to operate a power printed circuit board. A pyro sensor printed circuit board on a sensor printed circuit board regulates the power supply and connects it to the $L^1$ contact which connects to the lighting fixture (100). This circuitry is commonly known, and will not be explained further in details. It comprises a power printed circuit board, a sensor printed circuit board with a pyro printed circuit board, and a transmitter printed circuit board. The lens assembly (50) constitutes dotted lenses. Passive infrared rays (PIR) pass through the lens assembly (50), and reach the printed circuit board sub-assembly. Associated accessories and wirings cooperate to engage or disengage the lighting fixture (100), which is known to those skilled in the art.

Following the above disclosure of the first embodiment (both adapted for vertical and horizontal mounting), the invention also teaches two methods of operating a lighting fixture (100) with and without the sensor module (200).

An operating method includes the steps of: providing an electrical wiring to the housing space (101) in parallel to the main electrical wiring; and inserting a dummy cover into the internal holder (30) when not controlling the lighting fixture (100), whereby the lighting fixture (100) reverts to the on/off switching of the main electrical wiring when the internal holder (30) is not fitted with a sensor module (200).

Another operating method includes the steps of providing an electrical wiring to the housing space (101) in parallel to the main electrical wiring; and inserting a sensor module (200) into the internal holder (30) when controlling the lighting fixture (100), the sensor module (200) includes a control module (20) comprising a top cover (10), a lower cover (60) and a printed circuit board sub-assembly (50) inside and a lens assembly (50), whereby an external movement will activate the sensor module (200) and ultimately the lighting fixture (100).

The sensor-monitored method of operating the lighting fixture (100) further includes the step of providing external adjustment knobs (61) on the control panel wall (62) of the lower cover (60) cooperating with the printed circuit board sub-assembly, whereby the retractable sensor module (200) can be retracted into or extended from the internal holder (30), and the external adjustment knobs (61) are concealed from view when the sensor module (200) is retracted.

Figure 10B:
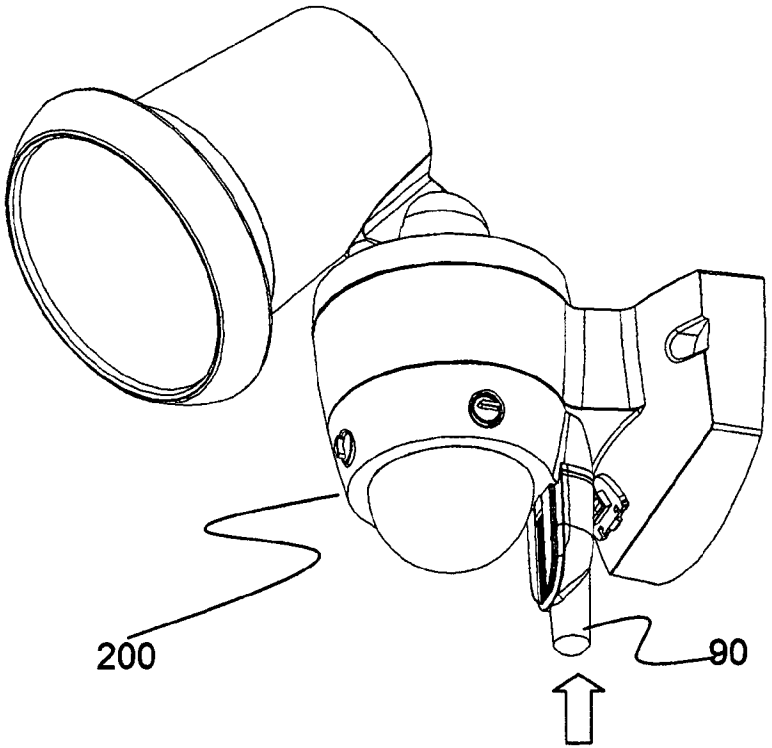
FIG. 10*b* shows a perspective view of the second embodiment as shown in FIG. 10*a*, fitted with a plug-in transmitter module.
Figure 10A:
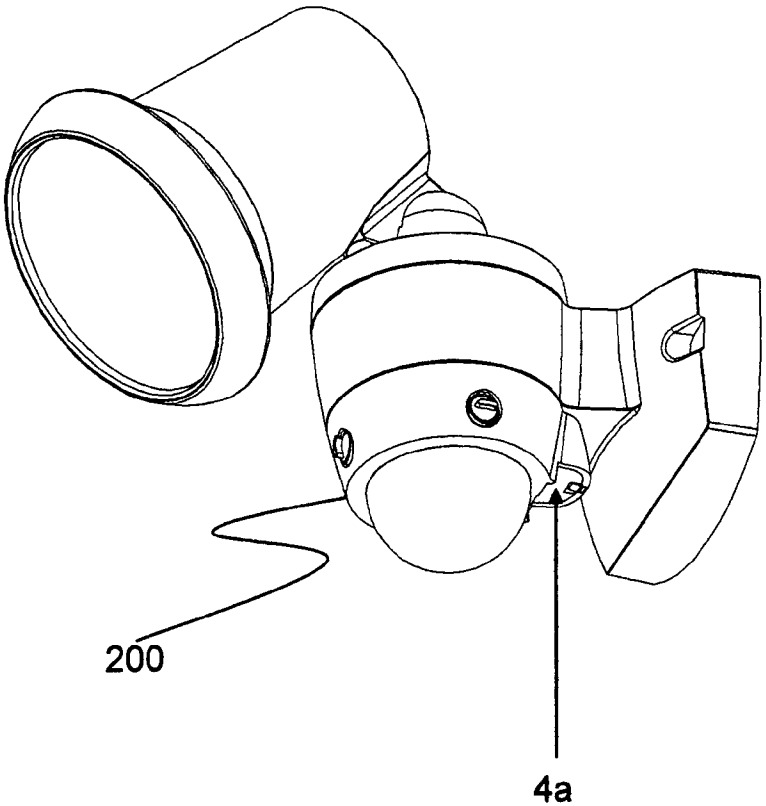
FIG. 10*a* shows a perspective view of a second embodiment of the present invention to be fitted with a retractable sensor module adapted for vertical mounting, but without a plug-in transmitter module.

In a second embodiment of the invention, a plug-in transmitter module (90) can be further added to the first embodiment of the present invention. As seen in FIG. 10*a*, the present invention is fitted with the retractable sensor module (200), but without the transmitter module (90). An electrical connection point is provided next to the retractable sensor module (200). When needed, this plug-in transmitter module (90) is inserted to the present invention as seen in FIG. 10*b*.

Figure 11:
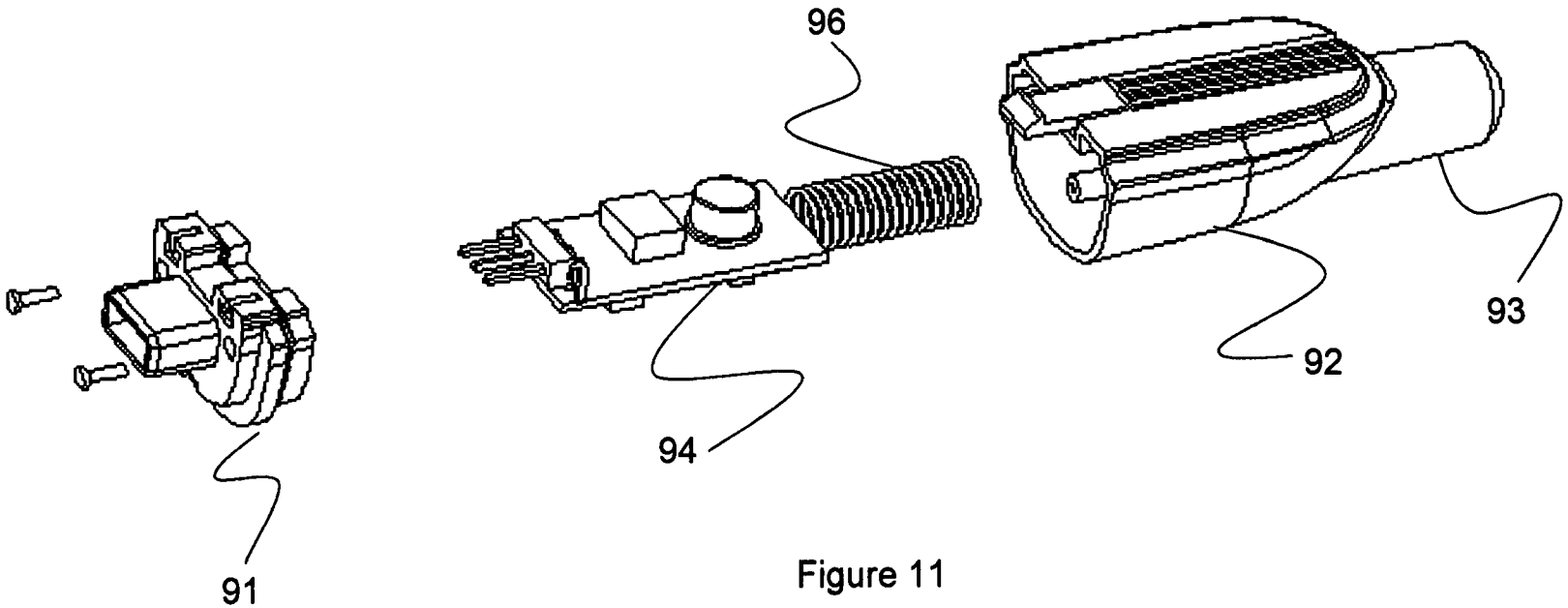
FIG. 11 shows a to-be-assembled view of various components making up the plug-in transmitter module as shown in FIG. 10*b*.

Various components making up the plug-in transmitter module (90) are shown in FIG. 11. The transmitter printed circuit board (94) is known to those skilled in the art. The transmitter printed circuit board (94) is housed in a bottom unit (92) with an extended element (93). The extended element (93) allows a transmission coil (96) to be received. A top unit (91) is employed to close the opening of the bottom unit (92).

In other words, the lighting fixture (100) is provided with two separate choices. A retractable sensor module (200) and later a plug-in transmitter module (90) can be separately purchased and inserted to the housing or connection space provided. When the plug-in transmitter module (90) is not inserted, the corresponding connection point is simply closed off with a dummy cover.

Following the above disclosure of the second embodiment (both adapted for vertical and horizontal mounting), the invention also teaches one further method of operating a lighting fixture (100) fitted with the sensor module (200) and the transmitter module (90).

Yet, another operating method includes the steps of: further providing a transmitter module (90) adjacent to a sensor module (200) fitted to a lighting fixture (100); and receiving and re-transmitting a signal from the sensor module (200) to a receiver product in a separate part of a building, whereas the receiver product includes a chime or a lighting fixture.

What is claimed is:

1. A light fixture (100), comprising a light means and a support means, is characterized in which:

the lighting fixture (100) is provided with a housing space (101) receiving a shiftable sensor module (200) wherein the sensor module has a protrusion (37);

the housing space (101) is provided with an internal holder (30) electrically connectable to an electrical circuitry operating the lighting fixture (100) wherein the internal holder 30 has an angularly directed duct-way (36) formed along a side wall thereof and penetrating entirely through the side wall;

the sensor module (200) includes a control module (20) comprising a top cover (10), a lower cover (60), a printed circuit board sub-assembly and a lens assembly (50);

adjustment knobs (61) are provided on a control panel wall (62) of the lower cover (60) cooperating with the printed circuit board sub-assembly; and the sensor module (200) includes other electrical circuitry therein connecting with the internal holder (30) and having said protrusion fitted into said duct-way, the sensor module (200) being rotatable relative to said internal holder (30) with said protrusion (37) shifting along said duct-way (36) to move said sensor module between a retractable position and an extendable position with respect to the internal holder (30) inside the housing space (101) of the lighting fixture (100) to conceal and expose respectively the adjustment knobs (61) appearing on the control panel wall (62) of the lower cover (60).

2. A lighting fixture (100) with the retractable sensor module (200) as in claim 1 in which the sensor module (200) is horizontally mounted on the lighting fixture (100), where the axis of the internal holder (30) is horizontal.

3. A lighting fixture (100) with the retractable sensor module (200) as in claim 1 in which the sensor module (200) is vertically mounted on the lighting fixture (100), where the axis of the internal holder (30) is vertical.

4. A lighting fixture (100) with the retractable sensor module (200) as in claim 2 or 3 and a dummy cover inserted into the internal holder (30) and converts the lighting fixture (100) to normal on-off switching, whereby the lighting fixture (100) is operational, even after the sensor module (200) has been withdrawn from the lighting fixture (100).

5. A lighting fixture (100) with the retractable sensor module (200) as in claim 1 in which the lighting fixture (100) is further provided with an electrical housing or connection point to receive optionally a plug-in transmitter module (90), whereby the transmitter module (90) redirects a signal from the sensor module (200) to another receiver product including a chime or a light fixture in a separate part of a building or an operation control room.

6. A lighting fixture (100) comprising a lighting means and a housing space (101) receiving a shiftable sensor module (200); the housing space (101) is provided with an internal holder (30) electrically connect-able to an electrical circuitry operating the lighting fixture (100); the sensor module (200) includes a lens assembly (50) and other electrical circuitry therein connected to the internal holder (30); wherein the sensor module (200) has a retracted position within the internal holder (30) and an extended position from the internal holder (30) inside the housing space (101) of the lighting fixture (100) while connected to the internal holder (30), said sensor module including a protrusion (37), and duct-way means (36) defined by a side wall of the internal holder (30) which penetrates entirely through the side wall and extends across the internal holder (30) that guides the sensor module (200) in a rotative movement between said retracted and extended positions, said protrusion (37) fitted within and slidable along said duct-way (36).

7. The lighting fixture (100) of claim 6 wherein the sensor module (200) includes a control module (20) associated with the lens assembly (50); adjustment knobs (61) carried by the sensor module (200) associated with the control module (20); the control knobs (61) being concealed with the sensor module (200) in said retracted position and exposed with the sensor module (200) in said extended position.

* * * * *

UNITED STATES PATENT AND TRADEMARK OFFICE

CERTIFICATE OF CORRECTION

PATENT NO. : 7,543,958 B2
APPLICATION NO. : 11/521584
DATED : June 9, 2009
INVENTOR(S) : Yung Chih Chi et al.

It is certified that error appears in the above-identified patent and that said Letters Patent is hereby corrected as shown below:

In Column 7, line 20, Claim 1, delete both occurrences of the word "light" and substitute therefor, -- lighting --.

In Column 8, line 11, Claim 4, following (30), delete "and converts" and substitute therefor, -- with --;

In Column 8, line 11, Claim 4, following (100), add -- converted --.

Signed and Sealed this

Twenty-second Day of September, 2009

David J. Kappos

David J. Kappos
*Director of the United States Patent and Trademark Office*